US006050857A

United States Patent [19]

Lok

[11] Patent Number: 6,050,857

[45] Date of Patent: Apr. 18, 2000

[54] SIM CONNECTOR AND RELATED CONTACT

[75] Inventor: Gordon Lok, Montebello, Calif.

[73] Assignee: Hon Hai Precision Ind. Co., Ltd., Taipei Hsien, Taiwan

[21] Appl. No.: 09/218,746

[22] Filed: Dec. 22, 1998

[51] Int. Cl.[7] ..... H01R 24/00

[52] U.S. Cl. ..... 439/630; 439/733.1; 439/862

[58] Field of Search ..... 439/630, 660, 439/862, 733.1, 751, 744

[56] References Cited

U.S. PATENT DOCUMENTS

| | | | |
|---|---|---|---|
| 3,696,323 | 10/1972 | Kinkaid et al. | 439/733.1 |
| 4,976,624 | 12/1990 | Ishizuka et al. | 439/862 |
| 5,259,777 | 11/1993 | Schuder et al. | 439/630 |
| 5,403,209 | 4/1995 | Lytle | 439/751 |
| 5,458,510 | 10/1995 | Nage, Jr. et al. | 439/733.1 |
| 5,882,212 | 3/1999 | McHugh et al. | 439/660 |
| 5,882,230 | 3/1999 | Bricaud et al. | 439/630 |
| 5,904,597 | 5/1999 | Doi et al. | 439/660 |
| 5,951,331 | 9/1999 | Li-Ming et al. | 439/862 |
| 5,997,315 | 12/1999 | Akama et al. | 439/862 |

*Primary Examiner*—Paula Bradley
*Assistant Examiner*—Tho D. Ta
*Attorney, Agent, or Firm*—Wei Te Chung

[57] ABSTRACT

An engagement structure of a card connector includes a housing and at least one contact partially received in the housing and partially exposed to an exterior thereof through a hole defined in the housing. Each contact includes a strip having a curved contacting portion extending from one end thereof, and a first wing portion extending laterally from two elongate sides of the strip and having slant tabs projecting upward therefrom. The housing includes a base having at least two elongate protrusions extending in parallel from an innersurface thereof thus defining a passageway therebetween for receiving the strip of the contact. A pair of notches are defined in opposite intermediate sides of each protrusion in communication with the adjacent passageway. A pair of tunnels are each defined from one end of each protrusion along a lengthwise direction thereof and through the notch thus defining a first block and a second block beside the notch and above the tunnel.

10 Claims, 4 Drawing Sheets

SIM CONNECTOR AND RELATED CONTACT

BACKGROUND OF THE INVENTION

1. Field of The Invention

The present invention relates to a subscriber identity module (SIM) card connector and related (contacts thereof, and especially to a SIM card connector having reliable engagement portions between a housing and contacts thereof.

2. The Prior Art

SIM card connectors are used with chip cards or IC cards in card reader systems such as those used in automated teller machines or ticket reading systems on buses and at subway train entrances. Normally, the SIM connectors have a plurality of contacts each of which is partially retained in a passageway of a housing and partially exposed for contacting with electrode terminals provided on a contacting surface of an IC card. Since different IC cards may be inserted into/withdrawn from the SIM connector hundreds of times a day, reliable retention of the contacts in the SIM connector becomes a critical factor in the overall function of the connector.

SUMMARY OF THE INVENTION

The primary purpose of the present invention is to provide a card connector and contacts thereof with reliable retaining means by which the contacts can be firmly positioned in a housing of the card connector without being affected by the impact of several different cards inserted into the connector.

To fulfill the above purpose, an engagement structure of a card connector includes a housing and at least one contact partially received in the housing and partially exposed to an exterior thereof through a hole defined in the housing. Each contact includes a strip having a curved contacting portion extending from one end thereof, a first wing portion extending laterally from elongate sides of the strip, and a slant tab projecting upward from each half of the first wing portion. The housing includes a base having at least two elongate protrusions extending in parallel from an innersurface thereof thus defining passageways therebetween. Each passageway receives the strip of the corresponding contact. A pair of notches are defined in opposite intermediate sides of each protrusion in communication with the corresponding passageway. A pair of tunnels are each defined from one end of each protrusion along a lengthwise direction thereof and through the notch thus defining a first block and a second block beside the notch and above the tunnel. Half of each first wing portion of the contact is retained in a portion of the tunnel defined between the first block and the base while each slant tab thereof is received in the notch and abuts against the second block.

DETAILED DESCRIPTION OF THE PREFERRED EMBODIMENT

Figure 1:
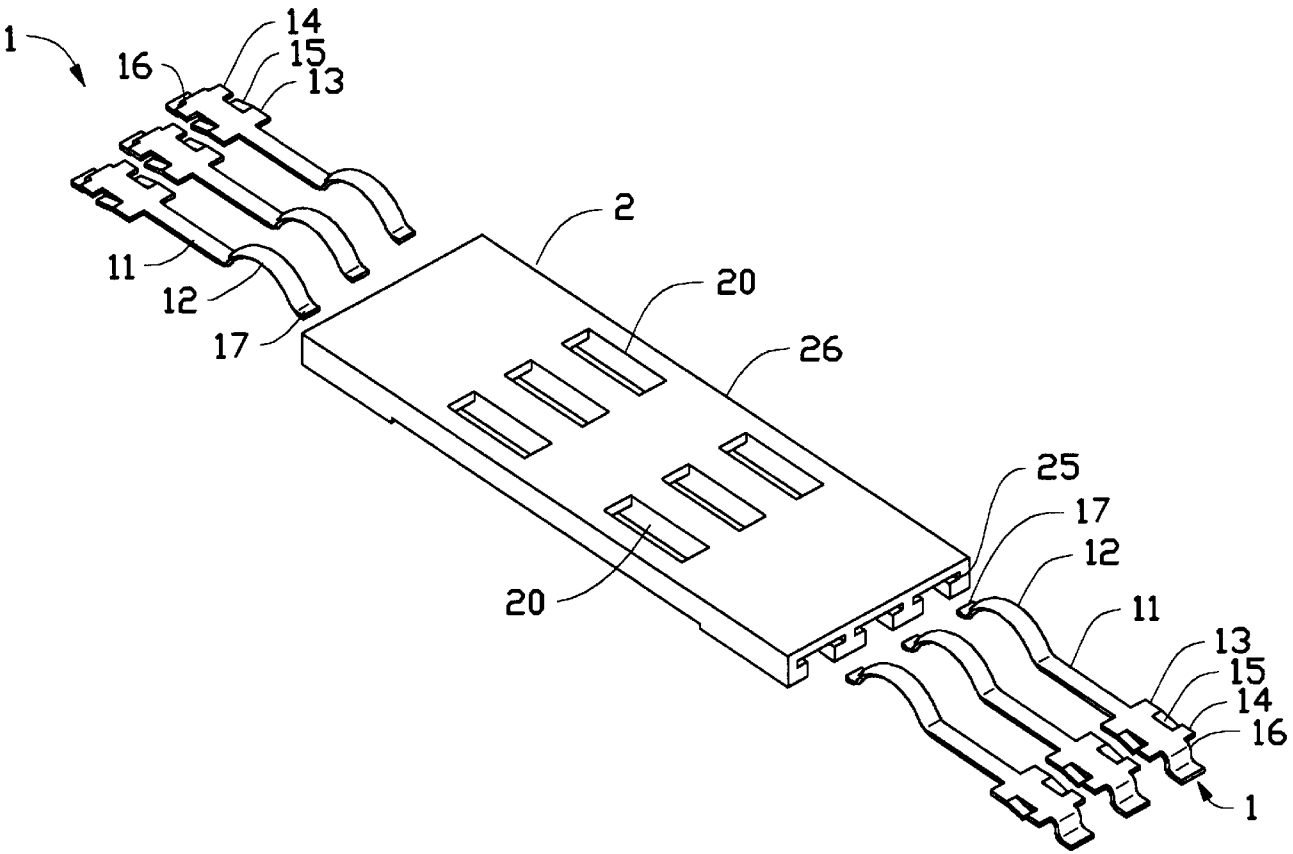
FIG. 1 is an exploded top view of a card connector in accordance with the present invention.
Figure 2:
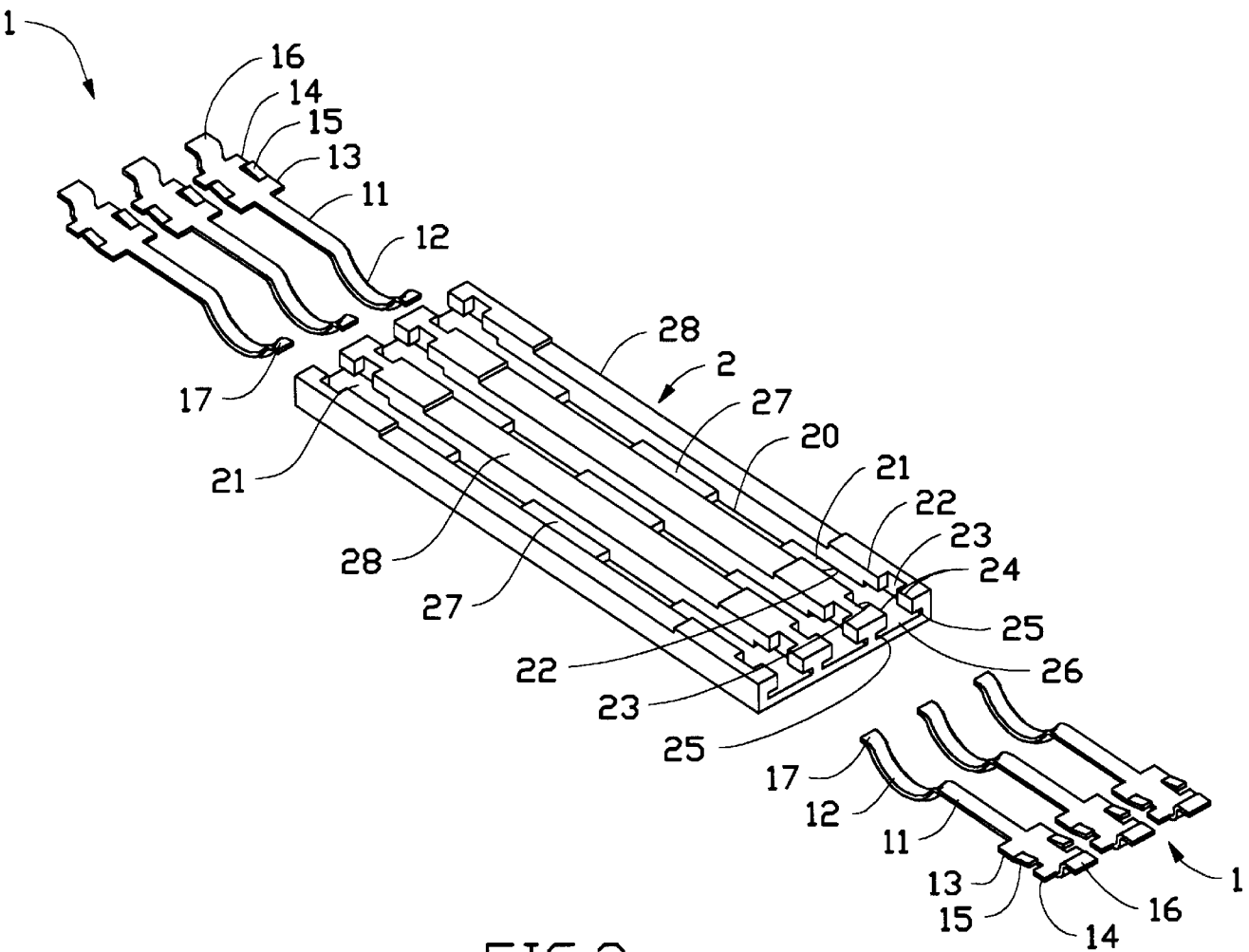
FIG. 2 is an exploded bottom view of a card connector in accordance with the present invention.

Referring to FIGS. 1 and 2, an engagement structure of a card connector in accordance with the present invention comprises a housing 2 and six contact 1 adapted to be received in the housing 2. Each contact 1 comprises a strip 11 having a bight 12 and a bent soldering tail 16 extending from opposite ends thereof for respectively contacting an IC card (not shown) and being soldered to a printed circuit board (not shown). A first wing portion 13 and a second wing portion 14 laterally extend from opposite intermediate portions of the strip 11, substantially coplanar with and parallel to each other, wherein the second wing portion 14 is adjacent to the soldering tail 16. Two tabs 15 extend from the first wing portion 13 at a slant and are offset from the second wing portions 14 a predetermined distance. Each tab 15 is resilient upon depressing a top thereof. A flat end 17 terminating from the bight 12 is substantially coplanar with the strip 11 and the two wing portions 13, 14.

The housing 2 comprises a base 26 defining six holes 20 arranged in an array. Particularly referring to FIG. 2, the housing 2 has four protrusions 28 projecting from the base 26. Adjacent protrusions 28 are separated from each other by two aligned holes 20 and a rib 27 formed therebetween. Two passageways 21 are defined between each adjacent pair of protrusions 28 and are separated by the corresponding rib 27.

Each protrusion 28 defines a notch 23 in each inner side thereof substantially near lateral edges of the base 26. A tunnel 25 is defined from each end of the protrusion 28 and through the notch 23. A first block 22 and a second block 24 are thus formed beside the notch 23 and above the tunnel 25.

A passageway 21 is defined and bound by an innersurface of the base 26, a pair of first blocks 22, and a pair of second blocks 24. Thus, there are a total of six passageways 21 defined in the housing 2 each receiving the corresponding contact 1. Each passageway 21 includes; a pair of opposite tunnels 25 which is capable of receiving the first and second wing portions 13, 14 of the corresponding contact 1.

Figure 4:
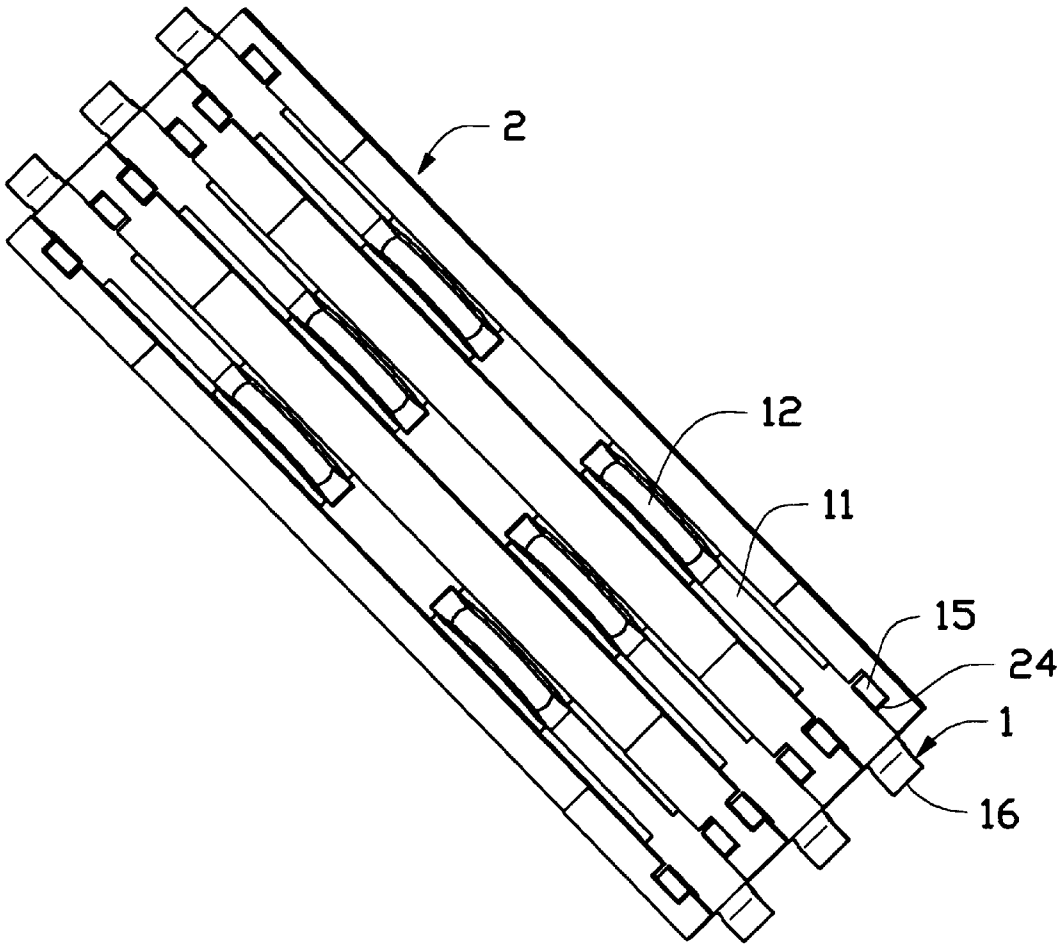
FIG. 4 is a bottom view of FIG. 3.

Also referring to FIG. 4, an end portion of each tab 15 abuts against the second block 24, the strip 11 is seated on the innersurface of the base 26, the bight 12 is received in the corresponding hole 20, and the flat end 17 of the bight 12 is seated on the corresponding rib 27. When the contact 1 is configured into the passageway 21, the tab 15 is temporarily deformed to pass through a portion of the tunnel 25 defined below the second block 24.

Figure 3:
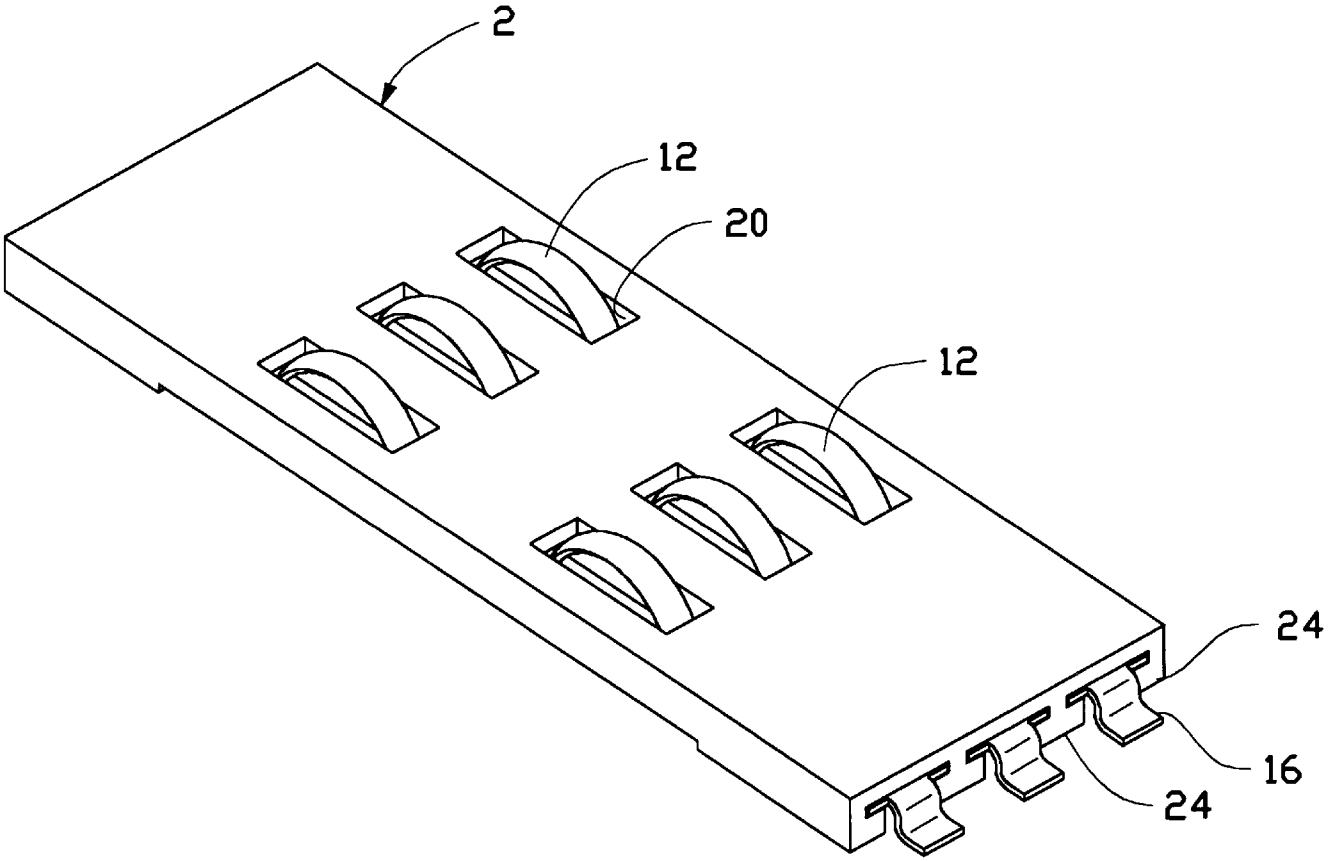
FIG. 3 is an assembled view of the contact and the housing.

FIG. 3 illustrates the assembly of the contacts 1 and the housing 2, wherein the bights 12 extend from the holes 20 for contacting with electrode terminals of an IC card (not shown). A cover (not shown) may be engaged with the housing 2, however, this is not related to the present invention, thus a detailed description thereof is omitted herein. With the above structure, it can be appreciated that impact from the frequent insertion of IC cards will not affect the positioning of the contacts 1 in the housing 2.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. An engagement structure of a card connector comprising a housing and at least one contact partially received in the housing and partially exposed to an exterior thereof through a hole defined in the housing;

each contact comprising a strip having a curved contacting portion extending from one end thereof, and a first wing portion extending laterally from two elongate sides of the strip and having slant tabs projecting upward therefrom;

the housing including a base having at least two elongate protrusions extending in parallel from an inner surface thereof thereby defining a passageway therebetween for receiving the strip of the contact, a pair of notches respectively defined in opposing inner sides of the protrusions and in communication with the adjacent passageway, a pair of tunnels each defined from one end of each protrusion along a lengthwise direction thereof and through the notch thus defining a first block and a second block beside the notch and above the tunnel;

wherein half of the first wing portion of the contact is retained in a portion of the tunnel defined between the first block and the base while each slant tab thereof is received in the notch and abuts against the second block.

2. The engagement structure of a card connector as claimed in claim 1 further comprising a second wing portion extending laterally from two elongate sides of the strip and substantially parallel to and coplanar with the first wing portion, wherein half of the second wing portion is retained in a portion of the tunnel defined between the second block of the protrusion and the inner surface of the base.

3. The engagement structure of a card connector as claimed in claim 1 further comprising a flat end terminating from the curved contacting portion and substantially coplanar with the strip and the first wing portion.

4. The engagement structure of a card connector as claimed in claim 1 further comprising a soldering tail extending from the other end of the strip for being soldered to a printed circuit board.

5. The engagement structure of a card connector as claimed in claim 4, wherein the soldering tail is a bent structure.

6. A contact of a connector comprising a strip having a curved contacting portion forwardly extending from one end thereof, and a first wing portion extending laterally from two elongate sides of one portion of the strip and having slant tabs, each slant tab having a sheared edge parallel to respective side edges of the elongate sides, and each slant tab being formed such that a free end of said slant tab protrudes out of a plane of said trip; and said strip further comprising a second wing portion extending laterally from two elongate sides of the other portion of the strip and substantially parallel to and coplanar with the first wing portion.

7. The contact as claimed in claim 6 further comprising a soldering tail extending from the other end of the strip for being soldered to a printed circuit board.

8. The contact as claimed in claim 7 further comprising a flat end terminating from the curved contacting portion and substantially coplanar with the strip and the first wing portion.

9. The contact as claimed in claim 8, wherein the soldering tail is a bent structure.

10. An electrical connector comprising:

a housing including a base, said base defining a plurality of through holes in a vertical direction, and a plurality of passageways in alignment with the corresponding holes in a horizontal direction, respectively, on an inner surface of the base;

a pair of tunnels defined by two sides of each of said passageways, and a pair of notches defined by two sides of each of said passageways in communication with said pair of tunnels; and a plurality of contacts adapted to be accommodated within the holes and the associated passageways, respectively; wherein each of said contacts includes a contact portion extending through the corresponding hole and to an exterior of the base, a strip received within the corresponding passageway, a wing portion laterally extending from the strip and received within the tunnels of the corresponding passageway, and slant tabs upwardly projecting from the wing portion and received within the notches of the corresponding passageway.

* * * * *